US008684561B2

(12) United States Patent
Quadri et al.

(10) Patent No.: US 8,684,561 B2
(45) Date of Patent: Apr. 1, 2014

(54) STAGE LIGHTING FIXTURE

(75) Inventors: Pasquale Quadri, Torre de' Roveri (IT); Angelo Cavenati, Brusaporto (IT)

(73) Assignee: Clay Paky S.p.A., Seriate (IT)

( * ) Notice: Subject to any disclaimer, the term of this patent is extended or adjusted under 35 U.S.C. 154(b) by 0 days.

(21) Appl. No.: 13/225,861

(22) Filed: Sep. 6, 2011

(65) Prior Publication Data

US 2012/0063147 A1 Mar. 15, 2012

(30) Foreign Application Priority Data

Sep. 7, 2010 (IT) ..... MI2010A1614

(51) Int. Cl.
*F21V 17/02* (2006.01)

(52) U.S. Cl.
USPC ..... 362/293; 362/296.01; 362/285

(58) Field of Classification Search
CPC ..... F21V 13/14; F21V 14/08; F21V 5/04
USPC ..... 362/296.01, 558, 285, 235; 359/298, 359/214.1
See application file for complete search history.

(56) References Cited

U.S. PATENT DOCUMENTS

| | | | | |
|---|---|---|---|---|
| 4,800,474 | A | 1/1989 | Bornhorst | |
| 5,309,340 | A | 5/1994 | Shigeta et al. | |
| 5,410,370 | A | 4/1995 | Janssen | |
| 6,034,473 | A | 3/2000 | McBride et al. | |
| 6,744,693 | B2 * | 6/2004 | Brockmann et al. | 362/321 |
| 2004/0095767 | A1 | 5/2004 | Ohmae et al. | |
| 2006/0193641 | A1 | 8/2006 | Callahan | |
| 2007/0279911 | A1 | 12/2007 | Kittelmann et al. | |
| 2009/0051886 | A1 * | 2/2009 | Akiyama | 353/98 |
| 2012/0230039 | A1 * | 9/2012 | Hansen Ellevang et al. | 362/351 |

FOREIGN PATENT DOCUMENTS

| | | |
|---|---|---|
| CN | 201162982 | 12/2008 |
| WO | WO 99/17052 | 4/1999 |
| WO | WO 2004/023036 | 3/2004 |

* cited by examiner

*Primary Examiner* — Tracie Y Green
(74) *Attorney, Agent, or Firm* — Leason Ellis LLP

(57) ABSTRACT

A stage lighting fixture having: a casing having a closed first end and an open second end; 5 a light source housed inside the casing, close to the first end, and which emits a light beam along an optical axis; an optical assembly positioned to intercept the light beam, and having a focal point located between the light source and the optical assembly; and a reflector coupled to the light source; the reflector and the light source being designed and coupled to concentrate the light beam substantially at a work point substantially coincident with the focal point of the optical assembly; and the light source being defined by a short-arc lamp to project a light bar.

20 Claims, 2 Drawing Sheets

STAGE LIGHTING FIXTURE

The present invention relates to a stage lighting fixture.

BACKGROUND OF THE INVENTION

Stage lighting fixtures are known comprising a casing with a closed first end and open second end; a light source housed inside the casing, close to the closed first end, and which emits a light beam along an optical axis; and an optical assembly positioned to intercept the light beam.

Lighting fixtures of this type are unable to produce a perfect, strong beam, i.e. produce a strong beam, but with chromatic defects in the form of a halo of a different colour from the beam.

SUMMARY OF THE INVENTION

It is an object of the present invention to provide a stage lighting fixture designed to eliminate the above drawbacks of the known art, and which is straightforward in design and cheap and easy to produce.

According to the present invention, there is provided a stage lighting fixture as claimed in Claim 1.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
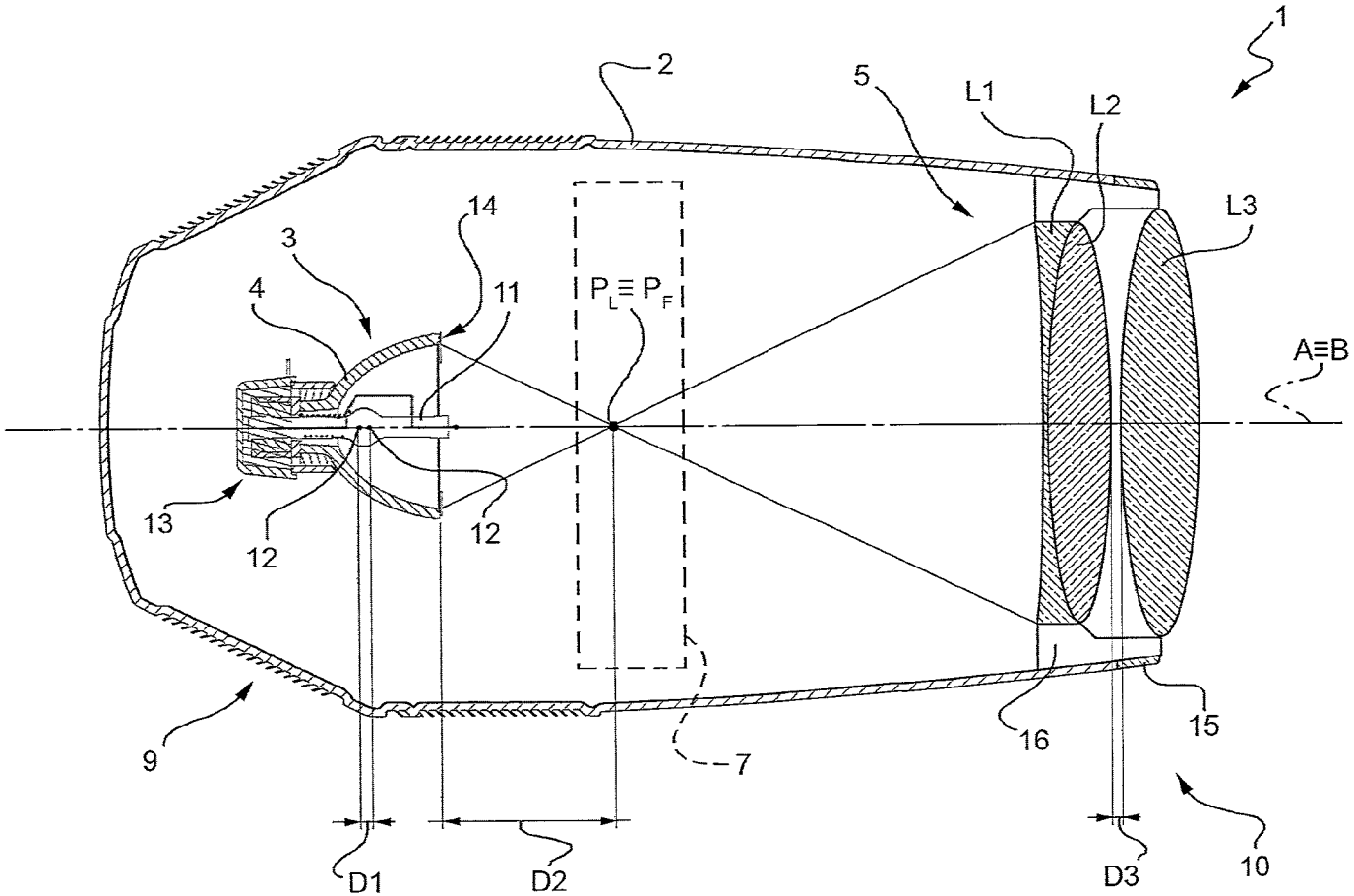
FIG. 1 shows a schematic, partly sectioned side view, with parts removed for clarity, of a stage lighting fixture in accordance with the present invention.

Number 1 in FIG. 1 indicates a stage lighting fixture comprising a casing 2, a light source 3, a reflector 4, an optical assembly 5, and a processing assembly 7.

Casing 2 extends along a longitudinal axis A, has a closed end 9, and an open end 10 opposite closed end 9 along axis A, and is preferably supported on supporting means (not shown for the sake of simplicity) to rotate about two perpendicular so-called PAN and TILT axes.

Light source 3 is housed inside and coupled to casing 2, at closed end 9 of casing 2, and emits a light beam substantially along an optical axis B.

In the non-limiting embodiment described and shown, optical axis B coincides with longitudinal axis A of casing 2.

Light source 3 is what is commonly referred to as a 'short-arc lamp'.

More specifically short-arc lamp 3 comprises a normally glass or quartz bulb 11 containing halogens.

Bulb 11 contains two electrodes 12 connected to a power circuit 13 (shown partly) and spaced a distance D1 apart.

Distance D1 between electrodes 12 is less than roughly 2 mm and, in the non-limiting example described and shown, is roughly 1 mm.

In the non-limiting example described and shown, short-arc lamp 3 has a power of roughly 189 watts.

Lamp 3, for example, is a PHILIPS MSD Platinum 5R type.

Reflector 4 is preferably elliptical, is coupled to light source 3, and has an outer edge 14.

More specifically, reflector 4 and light source 3 are designed and coupled to substantially concentrate the light beam at a work point $P_L$ at a distance D2 from outer edge 14 of reflector 4.

In the non-limiting example described and shown, distance D2 is roughly 34.5 mm.

In other words, reflector 4 and light source 3 are designed and coupled to emit a very strong, focused light beam.

Optical assembly 5 is located at open end 10 of casing 2, and is centred about optical axis B to close casing 2. More specifically, optical assembly 5 is fixed to a supporting ring 15, in turn fitted to casing 2, e.g. by screws (not shown for the sake of simplicity).

Optical assembly 5 has a focal point $P_F$ located between light source 3 and optical assembly 5.

In the non-limiting example described and shown, focal point $P_F$ substantially coincides with work point $P_L$.

Optical assembly 5 is preferably movable along axis A of casing 2 to adjust the position of focal point $P_F$.

Optical assembly 5 preferably comprises a biconcave lens L1, a biconvex lens L2, a biconvex lens L3, and a frame 16 supporting lenses L1, L2 and L3. Lenses L1 and L2 are connected, whereas lenses L2 and L3 are spaced apart by a distance D3, preferably of roughly 1 mm.

The characteristics of lenses L1, L2, L3 of optical assembly 5 are shown in the table below, where the term 'face a' refers to the beam entry face, and 'face b' to the beam exit face of the lens.

| LENS | RADIUS OF CURVATURE (mm) | THICKNESS (mm) | DIAMETER (mm) |
|---|---|---|---|
| L1 face a | 201.037 | 5 | 108 |
| L1 face b | 150.063 | | 108 |
| L2 face a | 150.063 | 30.700 | 108 |
| L2 face b | 86.321 | | 108 |
| L3 face a | 249.812 | 19.30 | 130 |
| L3 face b | 249.812 | | 130 |

Processing assembly 7 (shown schematically in FIG. 1) is housed inside casing 2, between light source 3 and optical assembly 5.

Figure 2:
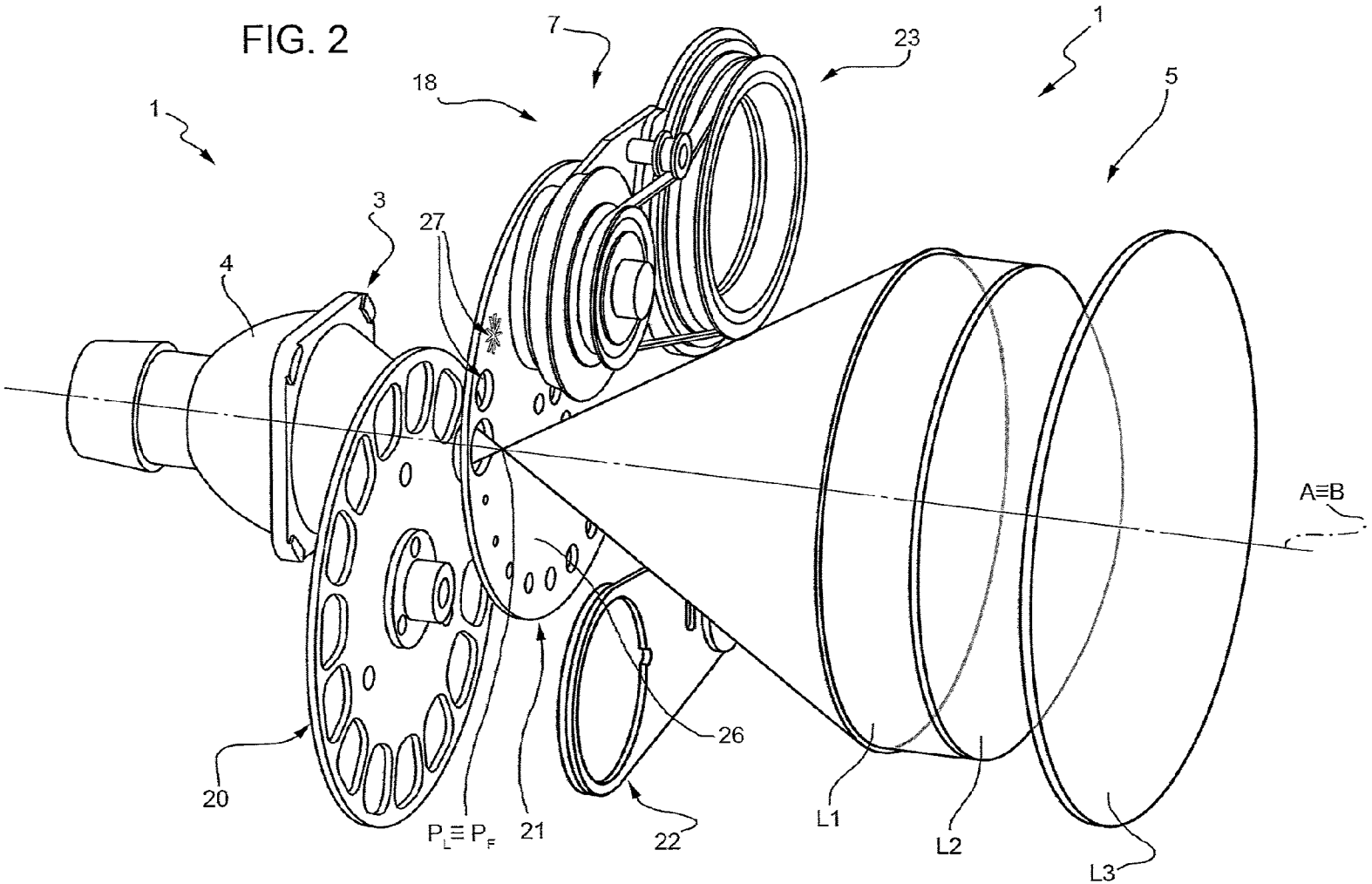
FIG. 2 shows a view in perspective, with parts removed for clarity, of the FIG. 1 stage lighting fixture.

As shown in FIG. 2, processing assembly 7 comprises beam light beam processing elements 18 for selectively modifying and intercepting the beam emitted by light source 3.

Processing assembly 7 preferably has actuating means (not shown) for moving light beam processing elements 18 along axis A, so the position of each light beam processing element 18 with respect to light source 3 and optical assembly 5 is adjustable.

In the non-limiting example described and shown, light beam processing elements 18 preferably comprise a colour assembly 20, a gobo assembly 21, a diffuser glass 22, and a prismatic lens 23.

Gobo assembly 21 comprises at least one disk 26, which preferably rotates about its axis, and in which are cut a number of gobos 27 of different shapes or patterns.

In a variation not shown, the gobos are disks fitted to disk 26 and therefore interchangeable as required.

In actual use, disk 26 rotates to selectively intercept the light beam with a given gobo 27 and project a respective light pattern.

Gobo assembly 21 is positioned so that the gobo 27 intercepting the beam is located substantially at work point $P_L$ coincident with focal point $P_F$.

The image projected of gobo 27 is thus of maximum intensity and focused.

Lighting fixture 1 according to the present invention thus generates a very strong and, at the same time, high-quality light beam.

The intensity of the beam is mainly due to using a high-efficiency short-arc lamp 3.

The high quality of the beam is mainly due to optical assembly 5, which eliminates any unsightly chromatic defects, and provides for optimum focus not obtainable, for example, using a Fresnel lens.

The lighting fixture according to the present invention, in fact, has no Fresnel objective.

The lighting fixture according to the present invention is able to exploit most of the intensity of the beam, due to focal point $P_F$ of optical assembly 5 coinciding with work point $P_L$.

Light source 3 and reflector 4 direct the beam to substantially one point: focal point $P_F$ of optical assembly 5, where it is caught by optical assembly 5 and projected in substantially parallel rays.

Optical assembly 5 thus catches and projects the strongest, brightest part of the beam generated by light source 3 and reflected by reflector 4.

Using a powerful, high-efficiency short-arc lamp combined with the particular configuration of light source 3 and reflector 4 (aimed at concentrating the beam at focal point $P_F$ of optical assembly 5) produces a particular optical effect: a sharp, homogeneous, very bright, substantially cylindrical, white 'light bar' with no aberration phenomena; the term 'light bar' being intended to mean a narrow, aligned, well defined, highly concentrated light beam.

In other words, lighting fixture 1 according to the present invention can generate beams of a brightness so far only achievable using lamps of nine times the power. In fact, the beam emitted by lighting fixture 1 according to the present invention is so concentrated and aligned as to resemble a laser beam.

Moreover, lighting fixture 1 according to the present invention is able to generate extremely bright light bars with much lower energy consumption as compared with conventional lighting fixtures, and with no loss in terms of projection quality.

The lamp used, in fact, has an absorption of no more than 189 W, and is also highly reliable, with an average working life of 2000 hours.

Finally, lighting fixture 1 according to the present invention is highly compact, by virtue of employing short-arc lamp 3, which, together with reflector 4, has a total axial length of roughly 60 mm.

Clearly, changes may be made to the stage lighting fixture as described herein without, however, departing from the scope of the accompanying Claims.

What is claimed is:

1. A stage lighting fixture for projecting a light bar comprising:

a casing having a first end and a second end;

a short-arc lamp, which is housed inside the casing (2), close to the first end (9), and emits a light beam;

a reflector (4), which is coupled to the short-arc lamp to direct the light beam along an optical axis; is shaped and spaced apart from the short-arc map to concentrate the light beam substantially at a work point ($P_L$) located along the optical axis; and an output optical assembly (5), which is located at the second end of the casing, is configured to have a focal point ($P_F$) located along the optical axis, and is spaced apart from the short-arc lamp so that the focal point coincides with the work point.

2. A lighting fixture as claimed in claim 1, wherein the short-arc lamp (3) comprises a bulb (11) containing two electrodes (12) connected to a power circuit (13) and spaced a first distance (D1) apart.

3. A lighting fixture as claimed in claim 2, wherein the first distance (D1) between the electrodes (12) is less than roughly 2 mm.

4. A lighting fixture as claimed in claim 2, wherein the first distance (D1) between the electrodes (12) is roughly 1 mm.

5. A lighting fixture as claimed in claim 1, wherein the reflector (4) has an outer edge (14); the work point ($P_L$) being located a second distance (D2) from the outer edge (14) of the reflector (4).

6. A lighting fixture as claimed in claim 5, wherein the second distance (D2) is roughly 34.5 mm.

7. A lighting fixture as claimed in claim 1, and comprising processing means (7) for processing the light beam; the processing means (7) being located between the light source (3) and the optical assembly (5).

8. A lighting fixture as claimed in claim 7, wherein the processing means (7) comprise one or more light beam processing elements (18); at least one light beam processing element (18) being located substantially at the work point ($P_L$).

9. A lighting fixture as claimed in claim 7, wherein the light beam processing elements (18) comprise at least a diffuser glass (22).

10. A lighting fixture as claimed in claim 7, wherein the light beam processing elements (18) comprise at least a color assembly (20).

11. A lighting fixture as claimed in claim 7, wherein the light beam processing elements (18) comprise at least a prismatic lens (23).

12. A lighting fixture as claimed in claim 7, wherein the light beam processing elements (18) comprise at least a gobo assembly (21).

13. A lighting fixture as claimed in claim 12, wherein the gobo assembly (21) comprises at least one disk (26) having a number of gobos (27) for intercepting the light beam; the gobo assembly (21) being positioned so that the gobo (27) in use is located substantially at the work point ($P_L$).

14. A lighting fixture as claimed in claim 1, wherein the output optical assembly (5) is movable to adjust the position of the focal point ($P_F$).

15. A lighting fixture as claimed in claim 1, wherein the output optical assembly (5) comprises a biconcave first lens (L1).

16. A lighting fixture as claimed in claim 15, wherein the output optical assembly (5) comprises a biconvex second lens (L2) coupled to the biconcave first lens (L1).

17. A lighting fixture as claimed in claim 16, wherein the output optical assembly (5) comprises a biconvex third lens (L3) located a third distance (D3) from the biconvex second lens (L2).

18. A lighting fixture as claimed in claim 17, wherein the third distance (D3) is roughly 1 mm.

19. A stage lighting fixture comprising:

a casing having a first end and a open second end;

a short-arc lamp, which is housed inside the casing (2), close to the first end (9), and emits a light beam;

a reflector (4), which is coupled to the short-arc lamp; to direct the light beam along an optical axis; is shaped and spaced apart from the short-arc lamp to concentrate the light beam substantially at a work point ($P_L$) located along the optical axis and an output optical assembly (5), which is located at the second end of the casing, is configured to have a focal point ($P_F$) located along the optical axis, and is spaced apart from the short-arc lamp so that the focal point coincides with the work point wherein the optical assembly (5) comprises at least one lens which is located at the open end (10) of the casing (2).

20. A stage lighting fixture comprising:

a casing having a closed first end and a open second end;

a short-arc lamp, which is housed inside the casing (2), close to the first end (9), and which emits a light beam;

a reflector (4), which is coupled to the short-arc lamp; to direct the light beam along an optical axis; is shaped and spaced apart from the short-arc lamp to concentrate the light beam substantially at a work point ($P_L$) located along the optical axis and an output optical assembly (5), which is located at the second end of the casing, is configured to have a focal point ($P_F$) located along the optical axis, and is spaced apart from the short-arc lamp so that the focal point coincides with the work point axis wherein the optical assembly (5) is the most downstream processing element along the optical axis.

* * * * *

UNITED STATES PATENT AND TRADEMARK OFFICE

CERTIFICATE OF CORRECTION

PATENT NO. : 8,684,561 B2
APPLICATION NO. : 13/225861
DATED : April 1, 2014
INVENTOR(S) : Pasquale Quadri and Angelo Canvenati It is certified that error appears in the above-identified patent and that said Letters Patent is hereby corrected as shown below:

On the Title Page, Item (57), in the Abstract, Line 2, delete "5"

Signed and Sealed this
Second Day of September, 2014

Michelle K. Lee

Michelle K. Lee
*Deputy Director of the United States Patent and Trademark Office*